United States Patent [19]

Ragan

[11] 4,095,210

[45] June 13, 1978

[54] HELICAL COIL SPRING WIPER POTENTIOMETER CONTACT DEVICE

[75] Inventor: Randall C. Ragan, Rancho Santa Fe, Calif.

[73] Assignee: North American Philips Corporation, New York, N.Y.

[21] Appl. No.: 723,931

[22] Filed: Sep. 16, 1976

Related U.S. Application Data

[63] Continuation-in-part of Ser. No. 642,328, Dec. 19, 1975, abandoned, which is a continuation-in-part of Ser. No. 452,130, March 18, 1974, Pat. No. 3,964,011.

[51] Int. Cl.[2] ..... H01C 10/40

[52] U.S. Cl. ..... 338/180; 338/202

[58] Field of Search ..... 338/180, 202, 174, 171

[56] References Cited

U.S. PATENT DOCUMENTS

| | | | |
|---|---|---|---|
| 3,531,753 | 9/1970 | Geese | 338/174 X |
| 3,703,699 | 11/1972 | Lahm et al. | 338/180 |

*Primary Examiner*—J. V. Truhe
*Assistant Examiner*—David A. Tone
*Attorney, Agent, or Firm*—Frank R. Trifari; Daniel R. McGlynn

[57] ABSTRACT

A contact device for trimmer potentiometer including a helical coil spring wiper embedded in a cavity in an insulative body so that movement of the helical coil spring wiper is prevented as the contact device is moved along the potentiometer substrate. The insulative body may alternatively be provided with thin walls surrounding the cavity containing the helical coil spring wiper to permit the contact device to absorb backlash, while still preventing any relative movement of the helical coil spring wiper.

4 Claims, 5 Drawing Figures

Fig 1
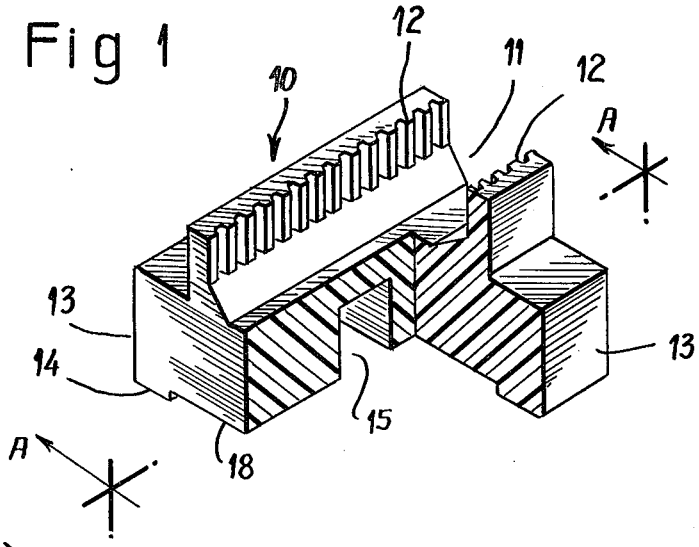
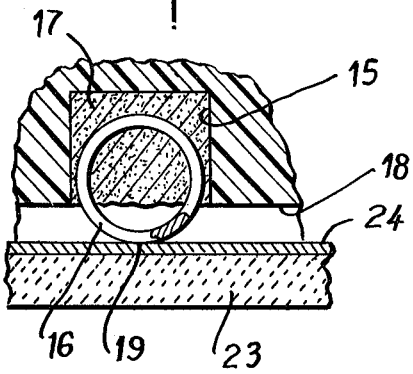
Fig. 2
Fig. 3
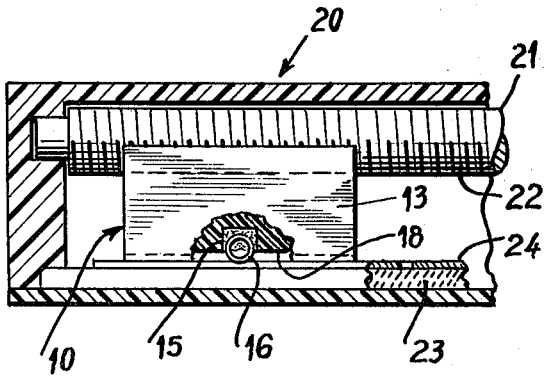
Fig 4
PRIOR ART
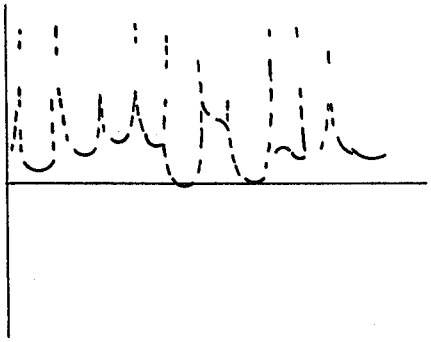
Fig. 5
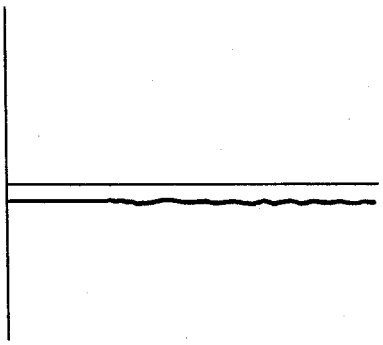

HELICAL COIL SPRING WIPER POTENTIOMETER CONTACT DEVICE

REFERENCE TO RELATED APPLICATIONS

This application is a continuation-in-part of copending U.S. application Ser. No. 642,328, filed Dec. 19, 1975, now abandoned which is in turn a continuation-in-part of application Ser. No. 452,130, filed Mar. 18, 1974, now U.S. Pat. No. 3,964,011, both of which applications are hereby incorporated by reference.

BACKGROUND OF THE INVENTION

The invention relates to contact devices for use in trimmer potentiometers, and in particular contact devices using a multi-wire or multi-finger wiper element. Potentiometers incorporating helical coil spring wipers have been known in the prior art, as amply discussed in the related applications incorporated herein. Such helical coil spring wipers are placed in cavities containing an element formed of a resilient material. In U.S. Pat. No. 3,531,753 for example, the helical coil spring wiper both rolls and slides along the surface of the resistance element. The individual coil sections of the spring in fact effect multiple electrical contacts with the resistance element. As a result, the electrical connection is not a smooth one, and the contact resistance variation (CRV) was not suitable for highly accurate commercial use of such potentiometers.

SUMMARY OF THE INVENTION

It is an object of the invention to provide a contact device including a helical coil spring wiper for effecting a uniform electrical wiping of a resistance element.

It is another object of the invention to provide a contact device in a trimmer potentiometer incorporating an embedded helical coil spring wiper.

It is another object of the invention to provide a contact device for use in a trimming potentiometer which includes integrally therewith a helical coil spring wiper.

It is still another object of the invention to provide a helical coil spring wiper which is adhesively connected to a contact device in a trimming potentiometer.

The present invention provides a potentiometer contact device comprising:

a contact body of electrically insulative material containing a cavity in one side thereof;

a helical spring wiper intimately bound in said cavity so that at least an arcuate portion of said coil wiper extends beyond said one side of said contact body; and engagement means on said contact body for enabling said contact body to be moved along a resistance element with said arcuate portion of said coil wiper making uniform electrical contact therewith for providing minimal contact resistance variation during such movement.

BRIEF DESCRIPTION OF THE DRAWING

FIG. 1 is a cut away isometric view of the slider block for a trimming potentiometer as taught by the present invention;

FIG. 2 is a cross-sectional view through the AA plane shown in FIG. 1 to more clearly illustrate the helical coil spring wiper as embedded within the slider block;

FIG. 3 shows the contact device according to the present invention disposed in operative position in a potentiometer, with portions of the latter in section in other portions broken away in the interest of clarity of illustration;

FIG. 4 is a graph of the contact resistance variation of prior art potentiometer utilizing a helical coil spring wiper which is free to roll as the potentiometer is adjusted; and FIG. 5 is a graph of the contact resistance variation of the potentiometer according to the present invention as the potentiometer is adjusted to a predetermined value.

DESCRIPTION OF THE PREFERRED EMBODIMENTS

Turning now to FIG. 1, there is shown a cut away isometric view of the slider block according to the present invention. The slider block 10 shown in FIG. 1 is made of an insulative material, and includes a longitudinal groove or trough 11 adapted to receive the lower portion of a length of a lead screw mounted for rotation in a known manner in a potentiometer housing. The bottom of the trough 11 is supplied with half threads 12 arranged for cooperative engagement with the complementive thread of lead screw.

The sides 13 of the contact device 10 are sloping, for the purpose of providing a clearance in the interior walls of the potentiometer.

The bottom portion of the slider block includes two parallel rails 14 which parallel the longitudinal groove 11 and enables the slider block to be positioned in the potentiometer and ride along the substrate thereof in a continuous and uniform manner.

The slider block 10 also includes a rectangularly shaped cavity 15 having a longer edge which is perpendicular to the rails 14. The cavity is adapted for containing the helical coil spring wiper with the axis of the wiper perpendicular to the rails 14.

In another embodiment of the invention, the cavity 15 in the slider block 10 may be replaced by a box (not shown) which contains the helical coil spring wiper. Such a box may have flexible walls which enable the helical coil spring wiper to self-adjust for backlash as the potentiometer slider block 10 is moved over the substrate while the potentiometer is adjusted to our particular resistance value.

FIG. 2 is a cross-sectional view of the slider block as shown in FIG. 1 through the AA plane. There is in particular shown the cavity 15 containing the helical coil spring wiper 16 which is embedded in an adhesive or glue 17. The adhesive or glue 17 throughly surrounds and immobilizes the helical coil spring wiper 16, and permits only a small arcuate portion 19 of the circumferential coil surface to extend below the lower surface 18 of the slider block 10. The purpose of this contact portion 19 of the helical coil spring 16 is to make electrical contact between the collector and the resistance element in the potentiometer in a manner known in the art.

The adhesive 17 is preferably resilient enough so as to permit individual turns of the helical coil to move with respect to one another, thereby adjusting for variations in the surface of the resistance or collector element.

FIG. 3 is a partially cut away view of a portion of a potentiometer incorporating the slider block 10 according to the present invention. There is shown the housing 20 of the potentiometer, and the lead screw 21 having threads 22 which engage the half threads 12 of the slider block 10. The substrate 23 includes a cermet or resistive film 24 on the surface of the substrate 23. The substrate 23 itself is located in the lower portion of the housing 20 where the slider block 10 can ride over it. The portion 19 of the helical coil spring wiper 16 makes electrical contact with the cermet film 24. Reference is made to the patent and applications incorporated by reference for further description of the electrical operation of a wiper in a rectangular trimming potentiometer.

FIGS. 4 and 5 are representations from oscilloscope tracings made from two substantially identical trimmer potentiometers, wherein the only distinguishing difference between the potentiometers is the type of contact device used. The particular experimental set up utilized two ¼-inch round trimmers, rated 100 ohms, and tested according to the specification of MIL-R-39035 A, using a Nicolet Digital Oscilloscope Model 10910. Both the signals represented in FIGS. 4 and 5 display the entire, unfiltered signal, with DC offset plus the contact resistance variation (CVR).

FIG. 4 is a representation of an oscilloscope tracing in which the coil is free to move about 0.055 inch in its cavity, and would therefore slide and roll during movement of the rotor in a manner similar to the prior art. The contact resistance variation is measured with a standard measuring circuit including a constant current source, and an AC-amplifier applied to an oscilloscope. The operating shafts of potentiometers were rotated in both directions through 90° of the actual effective electrical travel for a total of 6 cycles, with only the last three cycles being used to determine the contact resistance variation observed. The rate of rotation of the operating shaft was such that the wiper completed one cycle in 5 seconds, minimum, to 2 minutes, maximum. The oscilloscope tracing is a measurement of such contact resistance variation when performing slight forward and back movements, such as one would use in coming to a predetermined value in the center of resistance travel. One should note the particularly large increase in contact resistance including several peaks to over 10%.

FIG. 5 is a representation of an oscilloscope tracing using a substantially identical trimmer potentiometer in the same measuring circuit of FIG. 4, but featuring a contact device as taught by the present invention which completely restrains the coil from rotation. The same back and forth movements are imparted to the wiper as one would use in coming to a value in the center of resistance travel. It is noted that the peaks of contact resistance are substantially diminished compared to that in FIG. 4; and the CRV is limited to about 1% maximum. Such superior electrical characterictics and performance is believed to be a significant and useful improvement in the design of a helical coil spring wiper contact device compared with the prior art.

While the invention has been illustrated and described as embodied in a Helical Coil Spring Wiper Potentiometer Contact Device, it is not intended to be limited to the details shown, since various modifications and structural changes may be made without departing in any way from the spirit of the present invention.

Without further analysis, the foregoing will so fully reveal the gist of the present invention that others can, by applying current knowledge adapt it for various applications without omitting features that, from the standpoint of prior art, fairly constitutes essential characteristics of the generic or specific aspects of this invention and, therefore, such adaptions should and are intended to be comprehended within the meaning and range of equivalence of the following claims.

What is claimed as new and desired to be protected by Letters Patent is set forth in the appended claims.

1. A potentiometer contact device comprising:
   - a contact body of electrically insulative material containing a cavity in one side thereof;
   - a helical coil spring wiper bound in said cavity by adhesive means for restraining rotation of said wiper relative to said contact body so that at least an arcuate portion of said coil wiper extends beyond said one side of said contact body; and
   - engagement means on said contact body for enabling said contact body to be moved along a resistance element with said arcuate portion of said coil wiper making uniform electrical contact therewith for providing minimal contact resistance variation during such movement.

2. The device as defined in claim 1, wherein said engagement means comprises a longitudinal groove provided with half-threads for cooperative engagement with a lead screw.

3. The device as defined in claim 1, wherein said contact body includes two parallel rails on said one side for riding over a substrate.

4. The device as defined in claim 3, wherein said wiper extends perpendicular to said rails.

* * * * *